US009873959B2

(12) United States Patent
Stephan

(10) Patent No.: US 9,873,959 B2
(45) Date of Patent: Jan. 23, 2018

(54) METHOD FOR CONTROLLING A PIECING PROCESS FOR PIECING A YARN AT A WORK STATION OF A TEXTILE MACHINE

(71) Applicant: Rieter Ingolstadt GmbH, Ingolstadt (DE)

(72) Inventor: Adalbert Stephan, Beilngries/Paulushofen (DE)

(73) Assignee: Rieter Ingolstadt GmbH, Ingolstadt (DE)

( * ) Notice: Subject to any disclaimer, the term of this patent is extended or adjusted under 35 U.S.C. 154(b) by 0 days.

(21) Appl. No.: 15/386,688

(22) Filed: Dec. 21, 2016

(65) Prior Publication Data

US 2017/0175299 A1 Jun. 22, 2017

(30) Foreign Application Priority Data

Dec. 21, 2015 (DE) ..... 10 2015 122 391

(51) Int. Cl.

| | |
|---|---|
| ***D01H 4/50*** | (2006.01) |
| ***B65H 54/26*** | (2006.01) |
| ***B65H 67/08*** | (2006.01) |
| ***D01H 4/48*** | (2006.01) |
| ***D01H 15/00*** | (2006.01) |

(52) U.S. Cl.

CPC ..... *D01H 4/50* (2013.01); *B65H 54/26* (2013.01); *B65H 67/081* (2013.01); *D01H 4/48* (2013.01); *D01H 15/00* (2013.01)

(58) Field of Classification Search

CPC ..... D01H 4/50; D01H 4/48; D01H 4/52
USPC ..... 700/139
See application file for complete search history.

(56) References Cited

U.S. PATENT DOCUMENTS

| | | | | |
|---|---|---|---|---|
| 4,192,129 A * | 3/1980 | Stahlecker | D01H 4/48 | 57/261 |
| 4,716,718 A * | 1/1988 | Gobbels | D01H 4/50 | 57/263 |
| 4,744,209 A | 5/1988 | Wassenhoven | | |
| 4,944,033 A * | 7/1990 | Erni | D01H 13/145 | 700/130 |

(Continued)

FOREIGN PATENT DOCUMENTS

| | | |
|---|---|---|
| DE | 21 30 740 A1 | 12/1972 |
| DE | 35 02 118 A1 | 7/1986 |

(Continued)

OTHER PUBLICATIONS

German Search Report, dated Oct. 17, 2016.
EP Search Report, dated Apr. 26, 2017.

*Primary Examiner* — Danny Worrell
(74) *Attorney, Agent, or Firm* — Dority & Manning, P.A.

(57) ABSTRACT

With a method for controlling a piecing process for piecing up a yarn at a textile machine, in particular a spinning machine, by means of a piecing device, a multiple number of work steps as preparation for the actual piecing operation are carried out successively in a chronological sequence. In each case, a predetermined time period is allocated to the work steps. For at least one of the work steps, the predetermined time period can be varied, whereas the current time period of the work step is determined as a function of a yarn characteristic of the currently produced yarn and/or as a function of a utilization of the piecing device. A control unit is designed to operate the textile machine according to this method.

12 Claims, 2 Drawing Sheets

(56) References Cited

U.S. PATENT DOCUMENTS

| | | | | | |
|---|---|---|---|---|---|
| 5,237,807 | A * | 8/1993 | Iwade | D01H 13/005 | 188/158 |
| 5,385,009 | A * | 1/1995 | Schuller | D01H 4/50 | 57/263 |
| 5,611,195 | A * | 3/1997 | Lovas | D01H 13/005 | 57/1 R |
| 5,801,949 | A * | 9/1998 | Raasch | B65H 54/26 | 57/264 |
| 6,226,971 | B1 * | 5/2001 | Stephan | B65H 54/26 | 57/263 |
| 6,907,309 | B2 * | 6/2005 | Zipperer | B65H 54/26 | 57/264 |
| 7,113,843 | B2 * | 9/2006 | Bahlmann | B65H 54/26 | 700/130 |
| 2005/0182509 | A1 * | 8/2005 | Brandl | D01H 13/005 | 700/139 |

FOREIGN PATENT DOCUMENTS

| | | | |
|---|---|---|---|
| DE | 42 22 377 | A1 | 1/1994 |
| DE | 44 18 743 | A1 | 11/1995 |
| DE | 10 2012 100 553 | A1 | 7/2013 |
| DE | 10 2015 102 457 | A1 | 8/2016 |
| JP | H 09 31769 | A | 2/1997 |

* cited by examiner

METHOD FOR CONTROLLING A PIECING PROCESS FOR PIECING A YARN AT A WORK STATION OF A TEXTILE MACHINE

FIELD OF THE INVENTION

The present invention relates to a method for controlling a piecing process for piecing a yarn at a work station of a textile machine, in particular for restarting spinning of a yarn on a spinning unit of a spinning machine, by means of a piecing device. With the piecing process, multiple work steps are carried out successively in a chronological sequence, as preparation for the actual piecing operation, whereas a predetermined time period is allocated to the work steps within which the respective work step is carried out.

BACKGROUND

The piecing up of a thread after a thread breakage or after a clearer cut is carried out predominantly in an automated manner in modern open-end spinning machines, whereas the piecing is carried out either by a robot that can be moved along the spinning stations of the open-end spinning machine or by handling elements of the individual spinning station. In any case, initially, multiple preliminary work steps are always required for the piecing of a thread, which are carried out successively in a chronological sequence or in some cases parallel to each other. The work steps may comprise, for example, searching for a thread end on the bobbin surface that accrues on the bobbin, rewinding the thread end from the bobbin, preparing the yarn end for re-start of spinning, cleaning the spinning element, returning the prepared yarn end to the spinning element, and the like. By contrast, the actual piecing operation begins with the return of the thread end into the spinning element. Likewise, upon the splicing of a thread on a winding machine or other thread connecting processes on textile machines, a multiple number of preparatory work steps, successively in a chronological sequence or in some cases parallel to each other, are required.

With known textile machines, the individual work steps are always carried out with a cycle time that is constant over time; that is, the time period of the respective piecing step is fixed and also always lasts the same amount of time in different piecing processes. The cycle time is selected in such a manner that, on the one hand, an advantageous, short cycle time for this step is achieved in order to stop the work station of the textile machine for only a very short time; on the other hand, however, an acceptable success rate is achieved for this piecing step, such that time-consuming repetitions of piecing operations can be avoided.

In order to improve the success rate of individual work steps, some measures have already been proposed.

For example, DE 35 02 118 A1 describes a pneumatic cleaning process for cleaning friction surfaces of a friction spinning machine, in order to control the point in time and the time period of the pneumatic cleaning as a function of the degree of dirtiness to be expected. However, details are not provided as to the manner in which the degree of dirtiness to be expected is determined, and how the adjustment to the cleaning time takes place.

DE 44 18 743 C2 describes an optimization of the thread searching process that is intended to improve the certainty of finding the thread on the bobbin surface. In doing so, the sucking in of the thread end by a suction nozzle is monitored by means of a sensor. If, after a predetermined time period, the thread ending is absent, the rewinding speed of the bobbin is reduced (for example, to less than one third of the usual rewinding speed), in order to expose the thread end to the suction air stream for a longer period of time and thereby facilitate the sucking in of the thread end.

By means of such measures, an overall cost-effective operation of a textile machine can be achieved. However, such a control, directed at the success rate, of the individual work steps often has unfavorable effects on machine efficiency.

SUMMARY OF THE INVENTION

Therefore, a task of the present invention is to propose a method for controlling a piecing process, by means of which improved machine efficiency can be achieved. Additional objects and advantages of the invention will be set forth in part in the following description, or may be obvious from the description, or may be learned through practice of the invention.

The objects are solved with the characteristics of the methods and textile machine described and claimed herein.

With a method for controlling a piecing process for piecing up a yarn at a work station of a textile machine by means of a piecing device, a multiple number of work steps as preparation for the actual piecing operation are carried out successively in a chronological sequence. In each case, a predetermined time period is allocated to the work steps within which the respective work step is carried out. In doing so, the piecing device can be provided both on a maintenance device that can be moved along the work stations of the textile machine, and a piecing device of its own work station at the individual work stations of the textile machine. The textile machine can be formed, for example, as a winding machine or as a spinning machine. The invention can be used on any textile machine on which a yarn is produced or processed, and for which, after an interruption in production, the yarn must be fed back to the regular process on the textile machine. Correspondingly, a piecing process is understood with this invention as the re-start of spinning of a yarn on a spinning machine and the splicing on a winding machine or other yarn connecting processes.

It is now provided that, for at least one of the work steps, the predetermined time period can be varied, whereas the current time period of the at least one work step is determined as a function of a yarn characteristic of the currently produced yarn and/or as a function of a utilization of the piecing device and/or as a function of a success rate of the work step and/or as a function of the success of the individual work step. Preferably, the time period of the at least one work step is determined at least for each production batch as a function of the yarn characteristic of the produced yarn. Thus, with simple applications, with which the yarn can be handled easily in the respective work step because of its yarn characteristic, it is possible to substantially reduce the time period for this work step, without impairing the success rate of the respective work step. Conversely, in the case of more difficult applications, in which a more frequent failure of a certain work step is to be expected, this work step can be carried out more slowly (that is, with a longer cycle time), in order to increase the success rate of this work step. In doing so, the time period can be varied within wide limits and, depending on the current yarn characteristic, can also be set to 0 s (seconds); that is, a single step can be omitted altogether. On the other hand, in the case of a low utilization of the piecing device or certain yarn characteristics, certain work steps can also be added, by setting a certain time period for this starting from a standard time period of 0 s.

It is also possible to specify the time period of a work step as a function of a success rate of the work step. Thus, for example, after a failure of the work step in the preceding piecing process, the cycle time of the relevant work step can be increased in the current piecing process. Of course, it is also conceivable to record the success rate of a work step over several piecing processes, and to re-define the time period of the relevant work step as a function of the success rate. Independent of the criteria used to determine the time period, the time period for the relevant work step can be determined on a permanent or even only on a temporary basis, such that an adjustment or optimization is carried out continuously during operation.

In addition, it is also possible to determine the time period of a work step as a function of the success of the individual work step. This means that, for example after a failure of a work step in a piecing operation, the relevant work step is repeated, whereas, however, the time period of the work step is varied (in particular, it is increased).

Since the time periods of the individual work steps are frequently in the range of several seconds, a considerable reduction in the total cycle time can result overall, while the unproductive downtimes of work stations can be avoided.

In addition, the time period, which can be varied within wide limits, of certain work steps also offers the option of adjusting to certain operating conditions. Thus, the time period of a work step can also be determined as a function of the utilization of the piecing device. Thus, a shortened cycle time can be set for a particular work step, if there is a high degree of utilization of the piecing device, because many maintenance events arise or, in the case of movable piecing devices, another piecing device has failed. Thus, overall, the downtimes of the workstations can be kept low. Conversely, if only a few piecing processes have to be carried out, the cycle time of the relevant work step can also be increased in order to ensure the success of the relevant work step and to avoid operating requirements.

The time period of the individual work steps either can be carried out automatically by means of a control device on the basis of stored criteria, or can be specified manually. Thus, the option also exists of manually setting longer time periods in an effort for greater process reliability, for example if few operating personnel are available, or if a yarn of high quality is desired, and vice versa. Preferably, however, the current time period of the at least one work step is determined independently by a control unit of the textile machine.

On a spinning machine, the individual work steps preparatory to the start of spinning include at least the return of the yarn end into the spinning element, preferably also the preparation of the yarn end for the re-start of spinning-in and/or cleaning the spinning element.

Upon splicing on a winding machine, the work steps preparatory to piecing or splicing also include at least the introduction of the yarn into the splicing chamber. Additional steps may include searching for the thread end accumulated on the bobbin, rewinding, clamping and cutting to length the thread end, along with preparing the thread end for splicing.

It is particularly advantageous if the time period for searching for a yarn end that has accumulated on a bobbin and/or for feeding the yarn end at a handling element of the piecing device and/or for returning the yarn end into the work station of the textile machine, in particular into a spinning unit, is variable as a function of the yarn characteristic of the produced yarn. Here, for simple applications, the cycle time or time period for searching and/or returning can be shortened by up to 10 s and more. For example, a coarse yarn can generally be found on the bobbin surface relatively quickly, such that the time period of the thread search for such yarns can be shortened.

Preferably, different yarn characteristics are stored in an information memory device, each of which is allocated at least one suitable value of the time period for the at least one of the work steps. For the currently produced yarn, a value of the time period corresponding to its yarn characteristic is then selected from the information memory device. This can take place automatically by means of the control device or also by means of an operator.

As a rule, the time period for the respective work step arises from the fixed setting values for carrying out this work step. Therefore, for the work step of thread search, or the feeding of the yarn end at a working element of the work station, or the return of the yarn end into the work station, the current time period for the relevant work step is preferably specified by specifying the rewinding speed as a function of the yarn characteristic of the currently produced yarn. For example, a coarse, less sensitive yarn during thread search can be unwound at a high rewinding speed, since, in doing so, no yarn damage or further thread breaks have to be expected, and thereby a saving of time can be achieved. In order to proceed in a yarn-friendly manner in the case of a more sensitive yarn, a low rewinding speed can then be predetermined for such yarn.

Conversely, however, there are often problems of returning a coarse, relatively rigid yarn into the spinning element. Therefore, the time period for returning into the spinning element can be prolonged in order to ensure a successful return. This is preferably effected through the specification of a lower rewinding speed upon return.

Thus, a considerable increase in machine efficiency arises, since, on the one hand, it is possible to save a great deal of time when rewinding simple yarns. By specifying slower rewinding speeds, where necessary, yarn damage can again be avoided and unnecessary repetitions of the relevant step can be avoided, such that overall efficiency nevertheless increases.

According to a particularly advantageous additional form of the method, different yarn characteristics are stored in an information memory device. Such varying yarn characteristics are each allocated at least one suitable rewinding speed. With this method, for the currently produced yarn (that is, in the respective production batch), a rewinding speed corresponding to its yarn characteristic is selected from the information memory device. Thus, an optimized rewinding speed can be stored as a standard value for each yarn, such that the best compromise is achieved between a rapid processing and a high success rate of the respective work step. In doing so, of course it is also possible to store further values or value ranges for certain additional conditions for one or more yarn characteristics. If none of these additional conditions exist, the default value is selected from the information memory device. If, on the other hand, such an additional condition exists, a value corresponding to this condition and optimized for this condition is selected from the information memory device. In doing so, it is also possible to store permitted ranges in the information memory device, within which an adjustment is permissible.

Preferably, for the work step of the thread search, the rewinding speed is determined by means of the rotational speed of a roller that drives the bobbin. With a spinning machine, for the work step of returning into the spinning unit, the rewinding speed is determined by the rotational speed of spinning rollers.

It is advantageous if an initial value for the rewinding speed, which is preferably based on experience, is predetermined, and the rewinding speed is adjusted (in particular, reduced) starting from the initial value by means of a multiple number of piecing processes as a function of the success rate of the relevant work step, until a predetermined minimum success rate is achieved. In this manner, a temporal optimization of the relevant work step can be achieved, with process reliability that is nevertheless high.

It is particularly advantageous if, upon achieving the predetermined minimum success rate, the rewinding speed determined in the manner described above is selected as the working value for the rewinding speed for the subsequent piecing processes. Therefore, a determination of the optimum rewinding speed is only necessary at the beginning of a production batch; as soon as this is found, the subsequent piecing processes can then be carried out with the optimized rewinding speed, which is referred to here as the working value, rather than with the initial value based on experience values.

It is also advantageous if the optimized working value for the rewinding speed that is thus determined is stored in the information memory device, and is predetermined as the initial value for a subsequent production batch. Thus, in the case of the subsequent production batches that relate to the same yarn characteristic, the determination of a working value on the basis of a minimum success rate is not applicable.

In this case, the information memory device is preferably connected to the control device, such that the specification of a working value can take place automatically by means of the control device and the newly found working values can be stored automatically in the control device or the information memory device. The control device is thereby designed to be self-learning.

In addition to the work steps of thread search, and leading of the piecing device to a working element or return to the work station, in particular the spinning unit, the time period of other work steps can, of course, also be varied as a function of the yarn characteristic or the utilization of the piecing device.

As such, it is also advantageous if, in the case of a spinning machine, the time period for cleaning a spinning element of the spinning unit, in particular of a spinning rotor, is variable. Thus, in the case of a movable device for cleaning the spinning element, which is part of a movable maintenance or piecing device, the time period can be varied as a function of the utilization of the movable device. For example, with a high degree of utilization, a shorter cleaning time can be specified, in order to save time and avoid downtimes at other work stations that are also waiting for the device. Conversely, in the case of yarn types for which a high degree of dirtiness is to be expected, the time period for cleaning the spinning element can also be lengthened in order to avoid problems upon start of spinning and to ensure process reliability. For example, typical rotor cleaning times are in the range of 1 to 6 seconds. However, the variance of the cycle time can also amount to 10 seconds and more, such that machine efficiency can be considerably improved by such a shortening of the cleaning time.

According to an additional version of the method, the time period for at least one of the work steps can be varied, by varying the traversing speed of a handling element of the piecing device. For example, in the case of thicker, more robust yarns, handling elements can be moved more rapidly for transferring or storing a yarn end.

It is likewise advantageous if the current time period of the at least one work step is specified as a function of a bobbin format of the respective production batch. For example, for a cylindrical bobbin, the run-up or deceleration of the bobbin during start of spinning, or upon predictable spinning stops, can take place more quickly than for a conical bobbin.

Furthermore, it is advantageous if, during the carrying out of the at least one work step, the working result of the work step is determined and the current time period and/or the intensity of the work step during the carrying out of the work step is specified as a function of the determined working result. For example, in the case of a mechanical rotor cleaning, the working result can be determined by drawing a conclusion for the cleaning result from the power consumption of the motor by the drive of the cleaning device. The time period for the rotor cleaning is extended or shortened depending on the working result, by continuing the cleaning until the power consumption corresponds to that of a clean rotor. Thus, a different time period can be defined for each individual cleaning cycle within predetermined minimum and maximum time periods.

BRIEF DESCRIPTION OF THE DRAWINGS

Additional advantages of the invention are described on the basis of the following presented embodiments. The following is shown.

DETAILED DESCRIPTION

Figure 1:
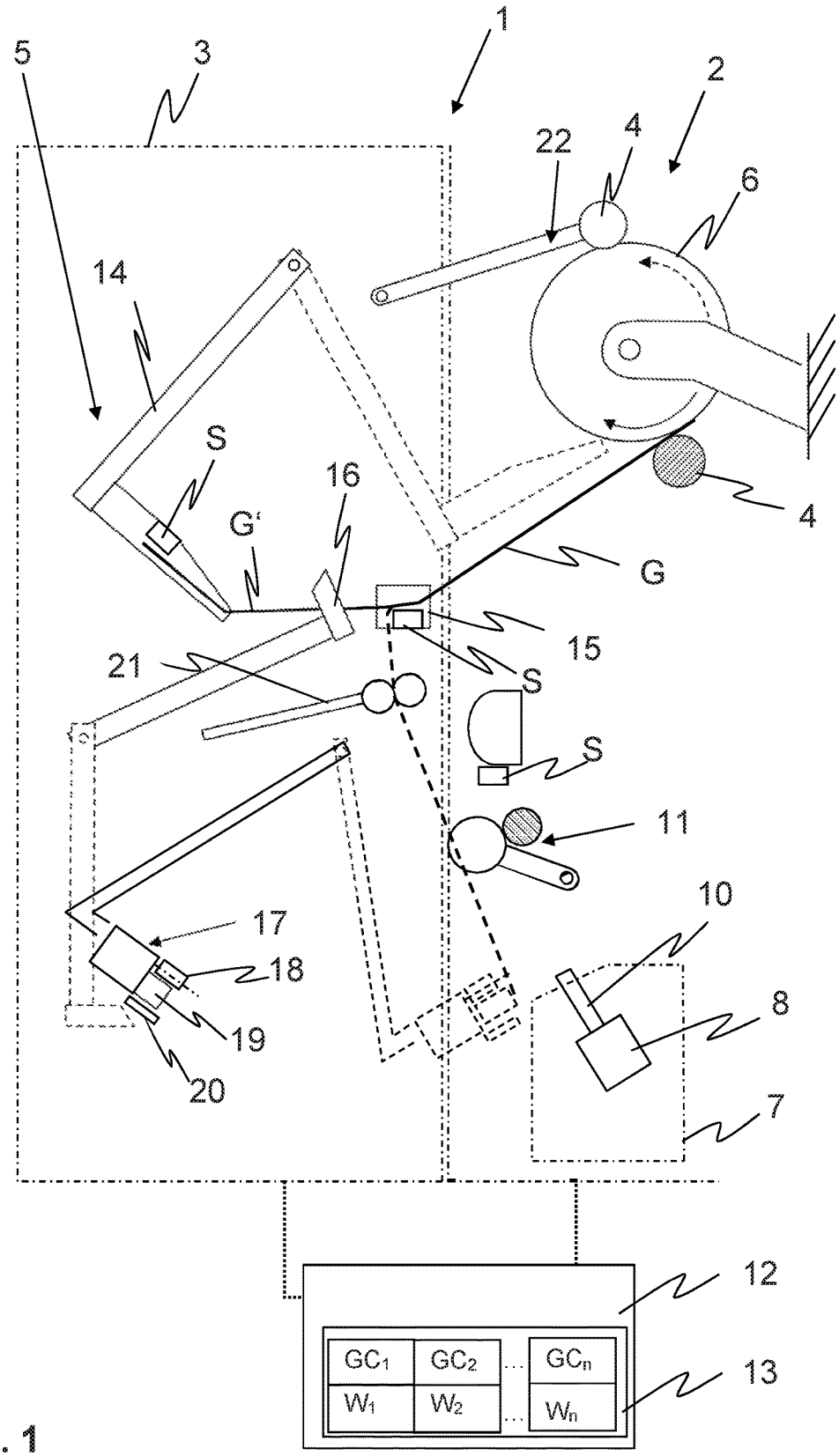
FIG. 1 a spinning station of a spinning machine with a multiple number of handling elements for starting spinning of a yarn in a schematic side view.

Reference will now be made to embodiments of the invention, one or more examples of which are shown in the drawings. Each embodiment is provided by way of explanation of the invention, and not as a limitation of the invention. For example features illustrated or described as part of one embodiment can be combined with another embodiment to yield still another embodiment. It is intended that the present invention include these and other modifications and variations to the embodiments described herein.

FIG. 1 shows a spinning station 2 of a spinning machine 1 in a schematic side view. The spinning machine 1 typically has a multiple number of spinning stations 2 arranged next to each other, each of which has a multiple number of working elements for producing a yarn G. For this purpose, each spinning station 2 has at least one spinning unit 7 with one spinning element 8 and one draw-off element 10. In the regular spinning mode, the yarn F produced by the spinning element 8 is drawn off by a draw-off device 11, and is fed to a bobbin 6 onto which it is wound. For this purpose, the bobbin 6 is mounted in a rotatable and drivable manner, whereas, in the present case, a roller 4 is provided for driving the bobbin 6. During regular spinning operation, the bobbin 6 is driven by the roller 4 into the yarn draw-off direction (dashed arrow). Alternatively, the bobbin 6 can also be driven by a direct drive.

Furthermore, the spinning machine 1 has a piecing device 5, which has a multiple number of handling elements 14, 15, 16, 17, 18, 19, 20, 21, 22 for starting spinning of the yarn G. In the present case, a suction nozzle 14, a pneumatic handling element 15, a yarn catcher 16, a feed unit 17 with a clamping device 18, a yarn preparation unit 19 and a separating device 20, along with an auxiliary pair of rollers 21, are shown as handling elements. According to the present example, the piecing device is arranged within a maintenance device 3 that can be moved along the spinning stations 2. Likewise, however, a piecing device can also be arranged at the spinning station 2. In addition, the handling elements 14, 15, 16, 17, 18, 19, 20, 21, 22 listed here are merely exemplary. Depending on the version of the spinning machine 1, some of the specified handling elements 14, 15, 16, 17, 18, 19, 20, 21, 22 are not required, or are provided instead of the specified other handling elements 14, 15, 16, 17, 18, 19, 20, 21, 22, which can also be combined to form different assemblies. Here, some of the handling elements 14, 15, 16, 17, 18, 19, 20, 21, 22 can also be exhibited with a sensor S, in order to monitor the presence of the yarn G. Sensors S can also be provided, which sensors detect the correct method or pivoting of the individual handling elements 14, 15, 16, 17, 18, 19, 20, 21, 22 or assemblies. In the present case, sensors are shown in the suction nozzle 14 and in the pneumatic handling element 15. In a conventional manner, an additional sensor S is arranged at the spinning station 2 in the yarn path, in order to monitor the presence of the yarn G and, if applicable, the quality of the yarn G.

If a thread breakage occurs or a clearer cut is carried out, the end of the yarn G accumulates on the bobbin 6 which is still rotating and, for starting spinning, must initially be searched for on the surface of the bobbin 6 (work step of thread search). For this purpose, according to the present example, the bobbin 6 is driven by a roller 4 of an auxiliary drive 22 in the direction opposite to the regular draw-off direction (solid arrow). Meanwhile, the suction nozzle 14 is pivoted in the direction of the bobbin 6 (dashed line), in order to search for and detect the yarn end G'. If the suction nozzle 14 has detected the yarn end G', it is pivoted into the position shown by the solid line, whereas the yarn G is fed to a pneumatic handling element 15. From the position shown by the solid line, the yarn end G' can now be detected by the yarn catcher 16 and, through pivoting the yarn catcher 16, can be fed into the position of the feed unit 17 shown by the dashed line. At the same time, the yarn end G' is inserted into the pair of auxiliary rollers 21, by means of which a temporary draw-off of the yarn F from the open-end spinning device 7 takes place after starting spinning.

In the work step of yarn end preparation, the yarn end G' is initially clamped in the clamping device 18 and is separated by a separating device 20. This results in a new yarn end G', which is now prepared in the yarn preparation unit 19 for re-start o spinning.

Meanwhile, in the spinning unit 7, the work step of cleaning of spinning element 8 can be carried out.

After the yarn end G' has been prepared, the work step of feeding the prepared yarn end G' to the spinning unit 7 is now carried out. For this purpose, the movably supported feed unit 17 is moved from its drawn-off preparation position into a feed position shown by a dashed line, and the yarn end G' is thereby placed in front of the draw-off element 10.

Subsequently, the work step of returning the yarn end G' into the spinning unit 7 or into the spinning element 8 takes place. For this purpose, the pair of auxiliary rollers 21 and/or an additional pair of auxiliary rollers 21 (not shown), which is arranged on the feed unit 17, is driven in the direction opposite to the regular draw-off direction, such that the yarn end G' finally reaches the effective area of the spinning element 8.

In the state of the art, the individual work steps for all applications were always carried out with a fixed cycle time or time period, such that, overall, a chronologically constant cycle sequence arose. As a rule, the time period of the individual work step was specified in such a manner that, even with more difficult yarns G, a good success rate of the relevant work step was achieved.

By contrast, it is now provided that, at least with individual work steps, the cycle time of this work step must be adjusted to the yarn characteristic GC of the yarn G currently being produced, in order to achieve a saving of time and an associated increase in machine efficiency. Likewise, the cycle time of a certain work step can also be prolonged, if this appears to be required for a more difficult application based on lower success rate of the relevant work step.

In the case of the spinning machine 1 shown here, an adjustment to the time period of the cleaning of the spinning element 8, or an adjustment to the time period of the yarn end preparation, comes into question. Likewise, a time period for the thread search, for the transfer of the yarn G by the yarn catcher 16, for the feeding of the yarn end G' to the spinning unit 7 and for the return of the yarn end G' into the spinning unit 7 can be predetermined.

In order to enable a comfortable setting of the time period of a work step, in the present case, an information memory device unit 13 is provided, which is in operative connection with a control unit 12 of the spinning machine 1. Different yarn characteristics $GC_1$, $GC_2$, . . . , $GC_n$ are stored in the information memory device 13, to each of which at least one suitable value $W_1$, $W_2$, . . . , $W_n$ of the time period for the respective work step is allocated. Thus, it is possible to obtain, after inputting the yarn characteristic GC of the respective current application by means of the information memory device 13, a value W suitable for this yarn characteristic GC. The stored values W are based on the experiences of prior piecing processes and, according to a first version, are permanently stored in the information memory device 13. Here, the selection of a suitable value W for the current yarn characteristic GC can be carried out by an operator. In this case, the control unit 12 merely proposes a certain, suitable value W for the current yarn characteristic GC; however, this still must be confirmed by the operator. Only then is this value W adopted by the control device 12, in order to control the piecing device 5 or its handling elements 14, 15, 16, 17, 18, 19, 20, 21 accordingly. However, it is particularly advantageous if the selection and adoption of a suitable value W takes place automatically by means of the control unit 12.

Figure 2:
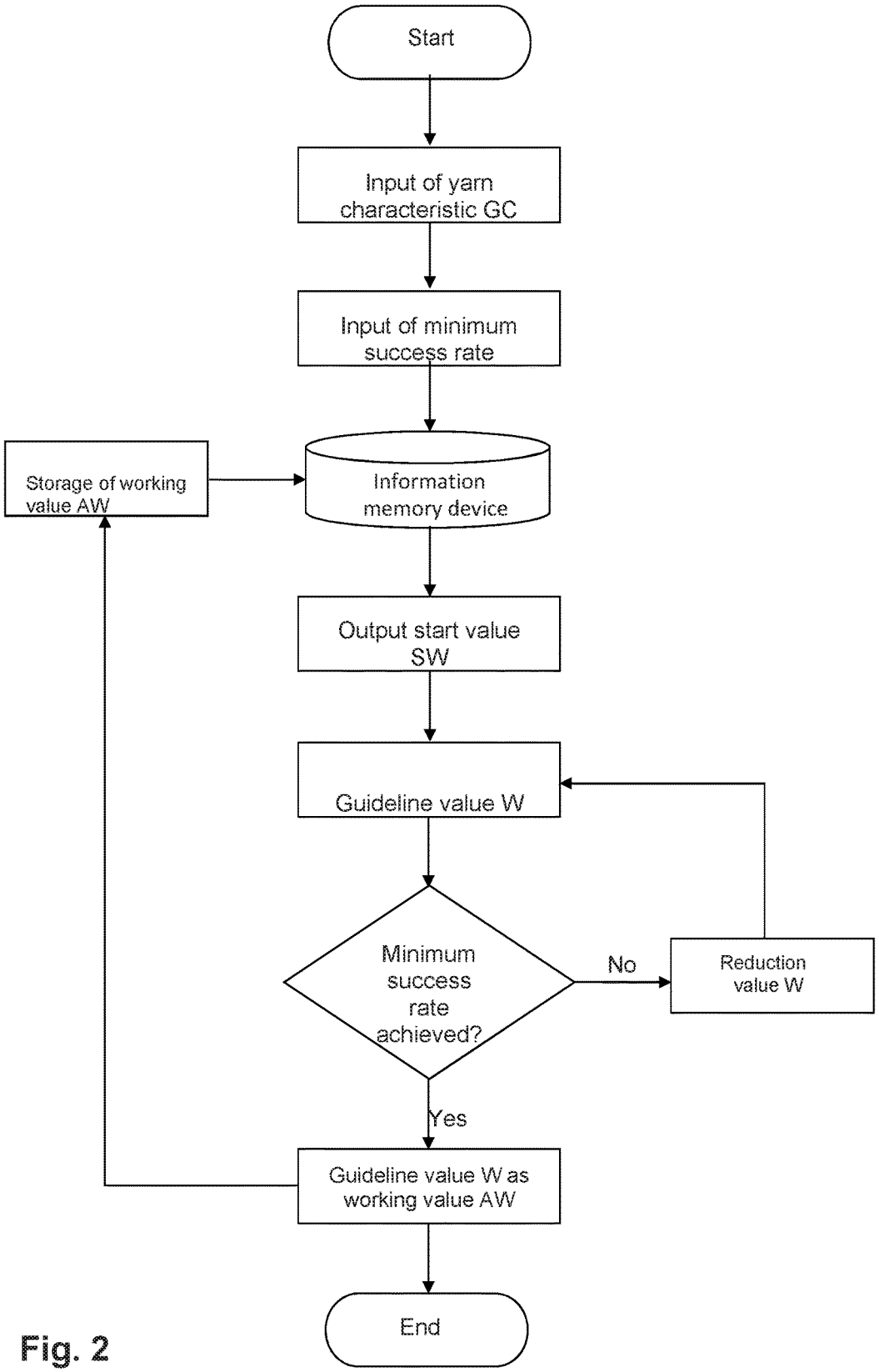
FIG. 2 a schematic view of the adjustment to the time period for a particular work step.

According to a particularly advantageous version, the control unit 12 is designed as a self-learning control unit 12, such that the values W stored in the information memory device 13 for certain yarn characteristics GC can be varied. In doing so, it is particularly advantageous if the initially selected value W of the time period of a work step can be automatically adjusted for a certain yarn characteristic GC, even during the spinning process or during a production batch. A corresponding procedure for adjusting the time period of a certain work step is shown schematically in FIG. 2.

While, for some work steps, the appropriate time period can be directly stored as the value W, in some other work steps, the time period for a certain work step arises from certain setting values for carrying out this work step. Such setting values can be, for example, the traversing speed of handling elements 14, 15, 16, 17, as the suction nozzle 14, the pneumatic handling element 15, the yarn catcher 16 and in particular the feed unit 17. The setting values can also be the rewinding speed of the yarn G or certain rotational speeds, for example the rotational speed of the pair of auxiliary rollers 21 or the roller 4 for driving the bobbin 6, or other parameters. In this case, the corresponding time periods are not stored as value W, but are stored as suitable values for such speeds or rotational speeds.

In the present case, the procedure is described using the example of the work step of thread search or the return of the yarn end G' into the spinning unit 7. In both cases, certain values W of the rewinding speed of the yarn G' are stored as setting values. As described in FIG. 1, at least one suitable value $W_1, W_2, \ldots, W_n$ of the rewinding speed is stored in the information memory device 13 for each yarn characteristic $GC_1, GC_2, \ldots GC_n$. At the beginning of the spinning process, in particular at the beginning of a certain production batch, the operator enters the yarn characteristic GC of the current application by means of the control unit 12. Furthermore, it is possible for the operator to enter a certain desired minimum success rate for the relevant work step. However, in contrast to the illustration shown, such a minimum success rate can also be permanently stored in the control unit 12. From the information memory device 13, for the entered yarn characteristic GC arising from the stored values $W_1, W_2, \ldots, W_n$, the value W suitable for this yarn characteristic GC can now be selected and can be output by means of the control unit 12 as the initial value SW. This initial value SW can now be predetermined, either automatically or by the operator, as a suitable value W for carrying out the relevant work step.

After preferably multiple piecing processes have been carried out with this predetermined value W, there can be an examination of whether the desired, previously entered minimum success rate or the permanently stored minimum success rate has been achieved. If this is the case, the predetermined value W is also used as a working value AW for future piecing processes, and a further adjustment to the value W is not required. However, if the minimum success rate is not achieved, the predetermined value W is reduced by means of the control unit 12, and this reduced value W is once again predetermined for carrying out the relevant work step. The correction of the value W, in this case the reduction of the value W of the rewinding speed, is carried out until the predetermined minimum success rate is achieved. As soon as this is the case, the value W determined in this manner is once again predetermined as the working value AW for future piecing processes, and a further adjustment is not required. In addition, the working value AW determined in this manner can be stored in the information memory device 13, in order to be able to serve as the initial value SW for future production batches from the outset.

However, an alternative or in addition to the above-described change to the time period as a function of a success rate of the relevant work step, by means of a multiple number of piecing processes, the time period can also be varied within a single piecing process as a function of a success of the individual work step. This is the case if a work step has been unsuccessful and has to be repeated.

For example, the rewinding speed upon searching for a yarn end G that has accumulated on a bobbin 6 (thread search) can be varied in order to improve the chances of success for the thread search. A value W of the rewinding speed is selected for the thread search and initially the thread search is started using a selected value W as the initial value SW of the rewinding speed of 1 m/s, for example. The time period for the work step of searching for the yarn end G is, for example, specified at a search time of 5 s as the initial value SW, and the work step is carried out at a regular negative pressure level.

If this work step is successful, the initial value SW of the rewinding speed is adopted as the working value AW for the subsequent piecing processes at other work stations. Likewise, the time period for the work step and the negative pressure level for the subsequent piecing processes remain unchanged.

If the work step fails, the selected initial value SW is changed, and the relevant work step, in this case the thread search, is repeated with the changed value W. For example, the rewinding speed is now reduced to 0.5 m/s. In doing so, the time period and the negative pressure level remain unchanged. If the thread search is now successful, the reduced rewinding speed of 0.5 m/s is now adopted as the working value AW for the subsequent piecing processes.

In the event of a further failure of the work step within the same piecing process, the reduced rewinding speed of 0.5 m/s can also be adopted as the working value AW for the repetition of the work step and for the subsequent piecing processes. However, an adjustment to additional values W is now carried out, and the relevant work step is now repeated with the adjusted values W. The negative pressure level can now be increased (for example). If the work step fails again, the time period for the thread search can be further increased starting from the initial value SW, here 5 s. However, if the relevant work step is successful, the values W for future piecing processes are reset to the initial values SW.

Only if the relevant work step frequently fails in the various piecing processes with the initial values, and thus the success rate of the relevant work step is low, will the changed values W, in this case the reduced rewinding speed, as described above, be permanently adopted or at least adopted for the respective part, as values W, in the control unit.

In the present case, the determination of suitable values W was described on the basis of the rewinding speed of the yarn G. In a similar manner, of course, suitable values W can also be determined for other setting values as described above. In doing so, of course, it not always necessary to start with a relatively high initial value SW and to reduce this successively. If more difficult applications, which require slower cycle times, are frequently required, starting with a low rewinding speed or a low value W, and successively increasing this until an acceptable success rate is achieved, can also be provided. In doing so, the success rate of a work step can be monitored, for example by means of sensors S, as described for FIG. 1.

Furthermore, the described procedure can also be used with the determination of suitable values W for certain setting values by means of an information memory device 13, in an analogous manner with other textile machines. For a winding machine, for example, an adjustment to the time period for yarn preparation, for the yarn search, for the transfer of the yarn G by a working element of the textile machine, for the feeding of the yarn end G' into the splicing chamber and, if applicable, for the returning of the yarn end G' into the work station can be predetermined.

Thus, for each individual step and for each yarn characteristic GC, the cycle time can be optimized such that an optimum efficiency arises for the particular application. In particular, if such an optimization of the cycle time is carried out for a multiple number of work steps of the piecing process, this results in considerable time savings and thus increases in efficiency.

Modifications and variations can be made to the embodiments illustrated or described herein without departing from the scope and spirit of the invention as set forth in the appended claims.

LIST OF REFERENCE SIGNS

1 Spinning machine
2 Spinning station
3 Maintenance device
4 Roller for driving the bobbin
5 Piecing device
6 Bobbin
7 Spinning unit
8 Spinning element
10 Draw-off element
11 Draw-off device
12 Control unit
13 Information memory device
14 Suction nozzle
15 Pneumatic handling element
16 Yarn catcher
17 Feed unit
18 Clamping device
19 Yarn preparation unit
20 Separating device
21 Auxiliary pair of rollers
22 Auxiliary drive
G Yarn
G' Yarn end
S Sensor
W Value
SW Initial value
AW Working value
GC Yarn characteristic

The invention claimed is:

1. A method for controlling a piecing process for piecing a yarn at work stations of a textile machine by means of a piecing device, the textile machine having a plurality of the work stations, wherein multiple preparation work steps are carried out at the work stations for the actual piecing operation in a chronological sequence, the method comprising:

allocating a predetermined time period to each of the work steps within which the respective work step is carried out;

for at least one of the work steps, changing the predetermined time period as a function of one or more of the following to decrease time for performing the work step or to increase likelihood of success of the work step:

(a) a yarn characteristic of the yarn being produced at the work station;

(b) utilization of the piecing device to perform some or all aspects of the work step;

(c) a success rate of the work step; or (d) success of the individual work step.

2. The method according to claim 1, wherein change of the predetermined time period of the at least one work step is determined independently by a control unit of the textile machine.

3. The method according to claim 1, wherein the predetermined time period is changed for one or more of the following work steps;

(a) searching for a yarn end that has accumulated on a bobbin;

(b) feeding the yarn end to a handling element of the piecing device;

(c) returning the yarn end into the work station of the textile machine for spinning of yarn at the work station; or (d) cleaning a spinning element of a spinning unit in the work station.

4. The method according to claim 1, wherein the predetermined time period for the at least one work steps is changed by varying the a traversing speed of a handling element of the piecing device.

5. The method according to claim 1, wherein the predetermined time period is changed as a function of a yarn characteristic of the yarn being produced at the work station, wherein different yarn characteristics are stored in an information memory device and are each allocated a time period value for the at least one work step, and wherein for the yarn being produced at the work station, the time period value for the yarn characteristic of the yarn is retrieved from the memory and is the predetermined time period for the work step.

6. The method according to claim 5, wherein the time period value for the at least one work step is achieved by specifying a rewinding speed value at the work station as a function of the yarn characteristic of the yarn being produced at the work station.

7. The method according to claim 6, wherein each of the different yarn characteristics stored in the information memory device is allocated a rewinding speed value, and wherein for the yarn being produced at the work station, the rewinding speed value for the yarn characteristic of the yarn is retrieved from the memory device.

8. The method according to claim 6, wherein an initial value for the rewinding speed is predetermined, and the rewinding speed is adjusted starting from the initial value in a subsequent multiple number of piecing processes until a predetermined minimum success rate of the work step is achieved.

9. The method according to claim 8, wherein the value of the rewinding speed upon achieving the minimum success rate is stored in the information memory device and set as the rewinding speed value for a subsequent piecing processes or the initial value of the rewinding speed for a subsequent yarn production batch at the work station having a same yarn characteristic.

10. The method according to claim 1, wherein the predetermined time period of the at least one work step is determined as a function of a bobbin format of a yarn production batch at the work station.

11. The method according to claim 1, wherein during performance of the work step, the predetermined time period is varied between a minimum and a maximum time period as a function of determination that the work step is successfully completed.

12. A textile machine configured to perform the method of claim 1 for controlling a piecing process for piecing a yarn at a work station of the textile machine.

* * * * *